US008437655B2

(12) United States Patent
Sakurai

(10) Patent No.: US 8,437,655 B2
(45) Date of Patent: May 7, 2013

(54) IMAGING UNIT, DEVELOPING UNIT, PHOTOSENSITIVE UNIT, AND IMAGE FORMING APPARATUS

(75) Inventor: Hideto Sakurai, Setagaya-ku (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 336 days.

(21) Appl. No.: 12/968,422

(22) Filed: Dec. 15, 2010

(65) Prior Publication Data

US 2011/0142512 A1 Jun. 16, 2011

(30) Foreign Application Priority Data

Dec. 16, 2009 (JP) ..... 2009-285046

(51) Int. Cl.
*G03G 21/00* (2006.01)

(52) U.S. Cl.
USPC ..... 399/98

(58) Field of Classification Search ..... 399/35, 399/98, 102, 249
See application file for complete search history.

(56) References Cited

U.S. PATENT DOCUMENTS 5,293,199 A * 3/1994 Saito et al. ..... 399/103
6,963,706 B2 11/2005 Morioka et al.

FOREIGN PATENT DOCUMENTS

JP 2003-307931 A 10/2003

* cited by examiner

*Primary Examiner* — Walter L Lindsay, Jr.
*Assistant Examiner* — Barnabas Fekete
(74) *Attorney, Agent, or Firm* — Buchanan Ingersoll & Rooney PC

(57) ABSTRACT

Provided is an imaging unit, including: a developing unit having a developing roller and a first abutting member; a photosensitive unit having a photosensitive drum and a second abutting member, a gap between the photosensitive drum and the developing roller being set constant by bringing the first abutting member into abutting contact with the second abutting member; a cleaner configured to be disposed in a space between the first and the second abutting members in a separate state where the first abutting member is spaced away from the second abutting member; and a displacement unit configured to displace the cleaner from the space as the first abutting member is brought close to the second abutting member. In the displacement, the displacement unit causes the cleaner to slide on an abutting surface of at least one of the first and the second abutting members.

19 Claims, 11 Drawing Sheets

IMAGING UNIT, DEVELOPING UNIT, PHOTOSENSITIVE UNIT, AND IMAGE FORMING APPARATUS

This application is based on application No. 2009-285046 filed in Japan, the content of which is hereby incorporated by reference.

BACKGROUND OF THE INVENTION (1) Field of the Invention

The present invention relates to an imaging unit detachable from an image forming apparatus, and in particular to a technique for cleaning a positioning member for defining a gap between a photosensitive drum and a developing roller.

(2) Description of Related Art

In electrophotographic image forming apparatuses, the gap between a photosensitive drum and a developing roller (referred to below as "developing gap") is a factor of great importance that affects an image quality, such as the density and blots due to carrier adhesion. As a method for retaining a prescribed developing gap, it is widely known to provide abutting members, such as gap rollers, on both ends of the developing roller, and bring the abutting members into abutting contact against the surface of the photosensitive drum.

However, with the repeated use of the image forming apparatus, more and more toner adheres to the surface of the photosensitive drum. Such toner present between the photosensitive drum and the gap roller hinders the developing gap from being properly retained, thus causing a risk of degradation of the image quality.

In order to address the above problem, the Japanese patent application publication No. 2003-307931 (referred to below as Document 1) discloses the following structure. That is to say, a cleaner, such as a felt, is provided to be in abutting contact with the surface of the photosensitive drum. The position on the surface of the photosensitive drum at which the cleaner abuts against is located upstream in a rotation direction of the photosensitive drum relative to the position on the surface of the photosensitive drum at which the gap roller abuts against. As the photosensitive drum rotates, the cleaner cleans the abutting portion of the surface of the photosensitive drum.

However, since the cleaning is achieved by the rotation of the photosensitive drum in the structure of Document 1, the technique is not applicable to apparatuses having the abutting members for positioning, including the photosensitive drum, that do not rotate. Furthermore, due to the abutting contact of the cleaner, the rotational loads of the photosensitive drum increases. This brings about a need for using a larger size motor, thereby increasing the cost. Moreover, the cleaner might abrade the surface of the photosensitive drum as a result of abrading, thereby causing a change in the developing gap over time.

SUMMARY OF THE INVENTION

The imaging unit comprises: a developing unit having a developing roller and a first abutting member; a photosensitive unit having a photosensitive drum and a second abutting member, a gap between the photosensitive drum and the developing roller being set constant by bringing the first abutting member into abutting contact with the second abutting member; a cleaner configured to be disposed in a space between the first and the second abutting members in a separate state where the first abutting member is spaced away from the second abutting member; and a displacement unit configured to displace the cleaner from the space as the first abutting member is brought close to the second abutting member, wherein in the displacement, the displacement unit causes the cleaner to slide on an abutting surface of at least one of the first and the second abutting members.

In an imaging unit including a developing unit and a photosensitive unit, the developing unit comprises: a developing roller; a first abutting member, a gap between the developing roller and a photosensitive drum of the photosensitive unit being set constant by bringing the first abutting member into abutting contact with a second abutting member of the photosensitive unit; a cleaner configured to be disposed in a space between the first and the second abutting members in a separate state where the first abutting member is spaced away from the second abutting member; and a displacement unit configured to displace the cleaner from the space as the first abutting member is brought close to the second abutting member, wherein in the displacement, the displacement unit causes the cleaner to slide on an abutting surface of at least the second of the first and the second abutting members.

In an imaging unit including a photosensitive unit and a developing unit having a developing roller and a first abutting member, the photosensitive unit comprising: a photosensitive drum; a second abutting member, a gap between the photosensitive drum and the developing roller being set constant by bringing the first abutting member into abutting contact with the second abutting member; a cleaner configured to be disposed in a space between the first and the second abutting members in a separate state where the first abutting member is spaced away from the second abutting member; and a displacement unit configured to displace the cleaner from the space as the first abutting member is brought close to the second abutting member, wherein in the displacement, the displacement unit causes the cleaner to slide on an abutting surface of at least the first of the first and the second abutting members.

The image forming apparatus includes one of the imaging unit, the developing unit, and the photosensitive unit as mentioned above.

BRIEF DESCRIPTION OF THE DRAWINGS

These and other objects, advantages and features of the invention will become apparent from the following description thereof taken in conjunction with the accompanying drawings that illustrate specific embodiments of the invention. In the drawings:

FIG. 6A is an arrow view (side view)

seen in a direction of an arrow C shown in FIG. 5, and FIG. 6B is an arrow view (front view) seen in a direction of an arrow D shown in FIG. 5.

FIG. 7A is a front view showing the state where an abutting member of the developing unit is just in contact with the cleaner. FIG. 7B is a front view showing the state where an abutting member of the developing unit is in abutting contact with an abutting member of the photosensitive unit.

FIG. 11A is a front view showing the state where the abutting member of the developing unit is spaced away from the cleaner. FIG. 11B is a front view showing the state where the abutting member of the developing unit is just in contact with the cleaner. FIG. 11C is a front view showing the state where the abutting member of the developing unit is in abutting contact with the abutting member of the photosensitive unit.

DESCRIPTION OF PREFERRED EMBODIMENTS

The following describes preferred embodiments of the present invention in conjunction with the drawings. In these embodiments, a tandem-type full-color digital printer (referred to below simply as "printer") is taken as an example.

[First Embodiment]

The following describes a first embodiment of the image forming apparatus according to the present invention.

(1-1. Structure of Printer)

Figure 1:
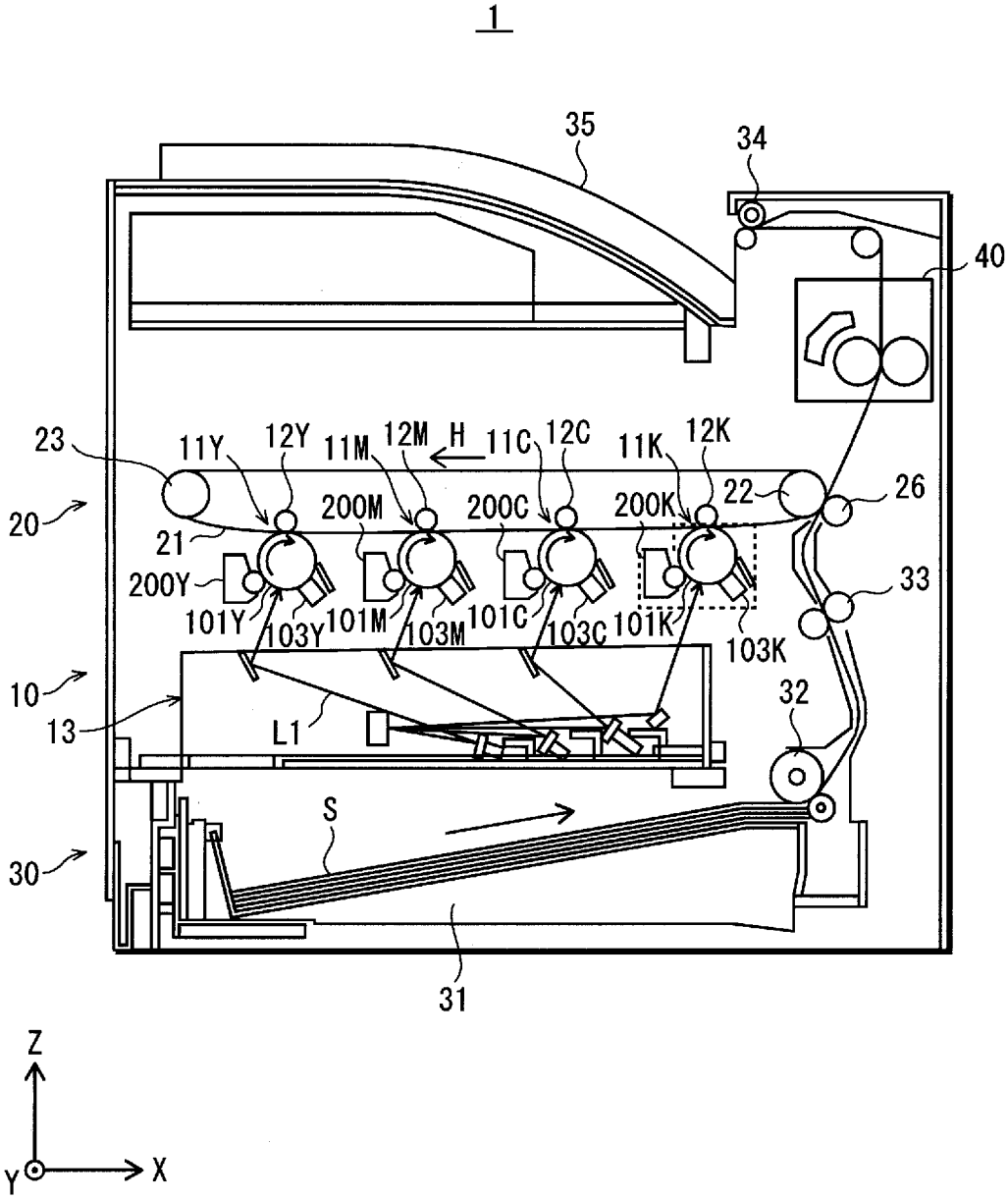
FIG. 1 is a schematic view showing an overall structure of an image foaming apparatus according to an embodiment of the present invention.

FIG. 1 is a section view schematically showing an overall structure of a printer 1.

The printer 1 forms is an image by a well-known electrophotographic method according to image data inputted from an external terminal (not shown). Also, the printer 1 includes an image processor 10, an intermediate transfer unit 20, a feeder 30 and a fixing unit 40.

The image processor 10 includes imaging units 11C, 11M, 11Y, and 11K for forming toner images in cyan (C), magenta (M), yellow (Y), and black (K), respectively. The image processor 10 also includes an exposure-scanning unit 13 that performs exposure-scanning on photosensitive drum 101, namely, electrostatic latent image carriers of the respective imaging units 11C, 11M, 11Y and 11K.

The intermediate transfer unit 20 includes an intermediate transfer belt 21 running around horizontally across a driving roller 22 and a driven roller 23 in a tensioned state, and rotates in a direction shown by an arrow H in FIG. 1.

The exposure-scanning unit 13 includes a light emitting device, such as a laser diode, for emitting a laser light L1 to perform exposure-scanning on the photosensitive drum 101C, 101M, 101Y, and 101K. In response to the exposure-scanning by the exposure-scanning unit 13, the respective imaging units 11C, 11M, 11Y and 11K form the toner images in the corresponding colors sequentially. Then, the toner images are primarily transferred and superimposed onto one another in a single position on the outer circumferential surface of the intermediate transfer belt 21 by an electrostatic force. The electrostatic force is generated in response to a voltage applied to primary transfer rollers 12C, 12M, 12Y and 12K that are provided in positions corresponding to the respective imaging units 11C, 11M, 11Y and 11K on the inner surface of the intermediate transfer belt 21. Thus, a full-color toner image is formed.

Meanwhile, the recording sheet is fed from the feeder 30 at an appropriate moment.

Then, the full-color toner image on the outer surface of the intermediate transfer belt 21 is secondarily transferred onto the recording sheet due to the electrostatic force generated by a predetermined voltage applied to a secondary transfer roller 26.

The full-color toner image is thermally fixed on the recording sheet by the fixing unit 40, and then is ejected to an external eject tray 35.

(1-2. Structure of Imaging Unit)

The imaging units 11C, 11M, 11Y and 11K included in the image processor 10 basically have the same structure except for the toner colors. Therefore, the following describes, as an example, a structure of the imaging unit 11K for forming the image using the black toner. In addition, the alphabetical letters indicating the toner colors are omitted for the sake of simplicity.

Figure 2:
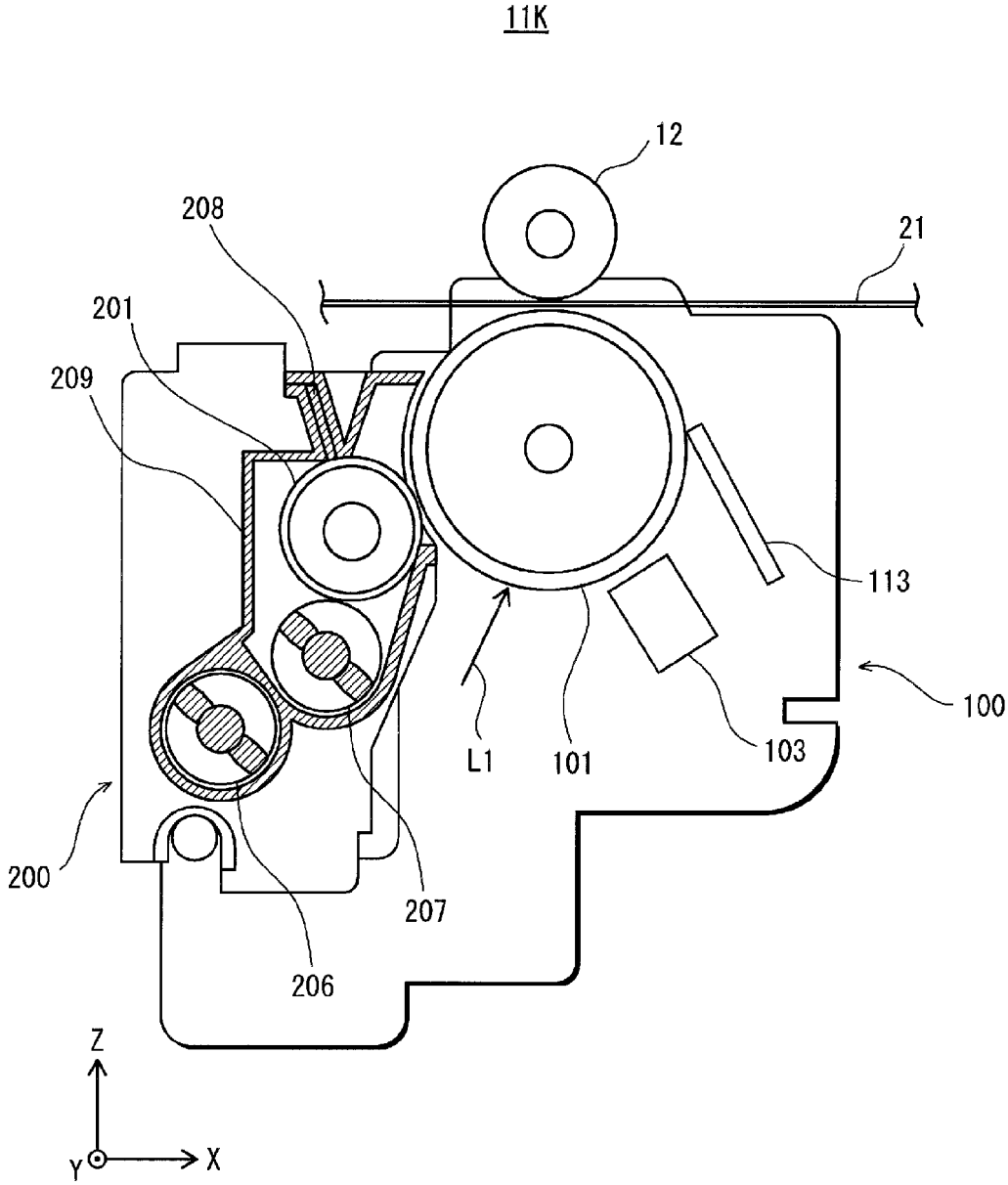
FIG. 2 shows a schematic structure of an imaging unit of the image forming apparatus according to the embodiment of the present invention.

FIG. 2 shows a schematic structure of the image formation unit 11K and other components therearound.

As shown in FIG. 2, the image formation unit 11K includes a photosensitive unit 100 having the photosensitive drum 101, and a developing unit 200 having a developing roller 201. The photosensitive unit 100 and the developing unit 200 are arranged such that the photosensitive drum 101 and the developing roller 201 face each other.

In addition to the photosensitive drum 101, the photosensitive unit 100 includes a charger 103 for charging the outer circumferential surface of the photosensitive drum 101 to a predetermined electrical potential, and a cleaner blade 113 for removing the toner remaining on the surface of the photosensitive drum after the transfer.

The primary transfer roller 12 is disposed to oppose the photosensitive drum 101 with the intermediate transfer belt 21 therebetween.

The developing unit 200 includes a housing 209 in which a first stirring screw 206, a second stirring screw 207, and a doctor blade 208, and others, in addition to the developing roller 201, are held. The first stirring screw 206 conveys the toner in a backward direction (i.e. -Y direction in FIG. 2) while stirring it. The second stirring screw 207 conveys the toner, which has been conveyed in the -Y direction by the first stirring screw 206, in a forward direction (i.e. Y direction in FIG. 2) so as to supply the toner to the outer surface of the developing roller 201. The doctor blade 207 regulates the amount of toner supplied onto the outer surface of the developing roller 201 so that a thickness of a toner layer adhered to the outer surface of the developing roller 201 is kept constant. Note that the housing 209 also functions as a toner container.

After the toner image formed on the photosensitive drum 101 is transferred onto the intermediate transfer belt 21, the cleaner blade 113 cleans the outer circumferential surface of the photosensitive drum 101 to remove the residual toner and other substances adhered thereto.

Figure 3:
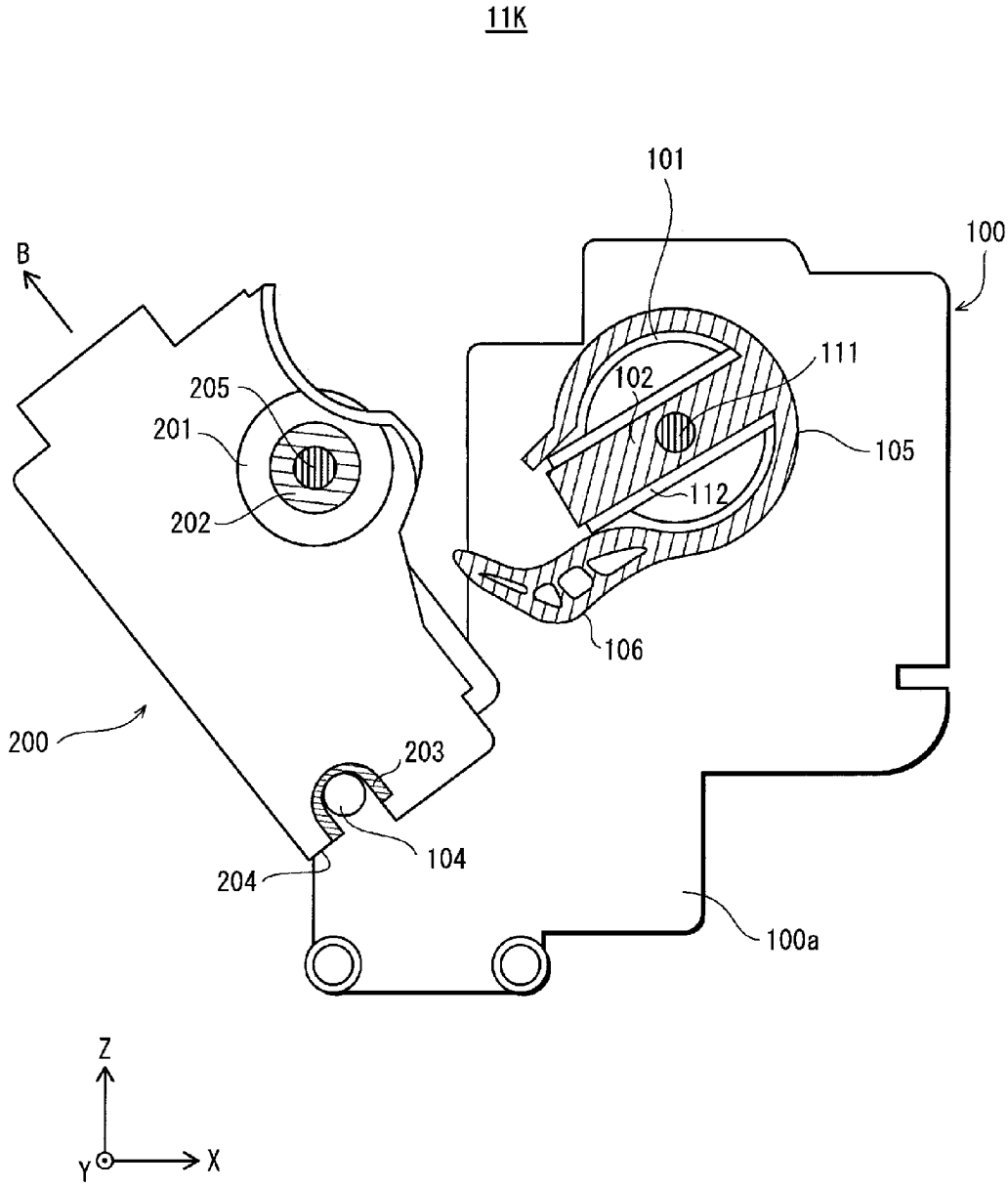
FIG. 3 is a sectional side view showing the imaging unit in the state where a developing unit is spaced away from a photosensitive unit.
Figure 4:
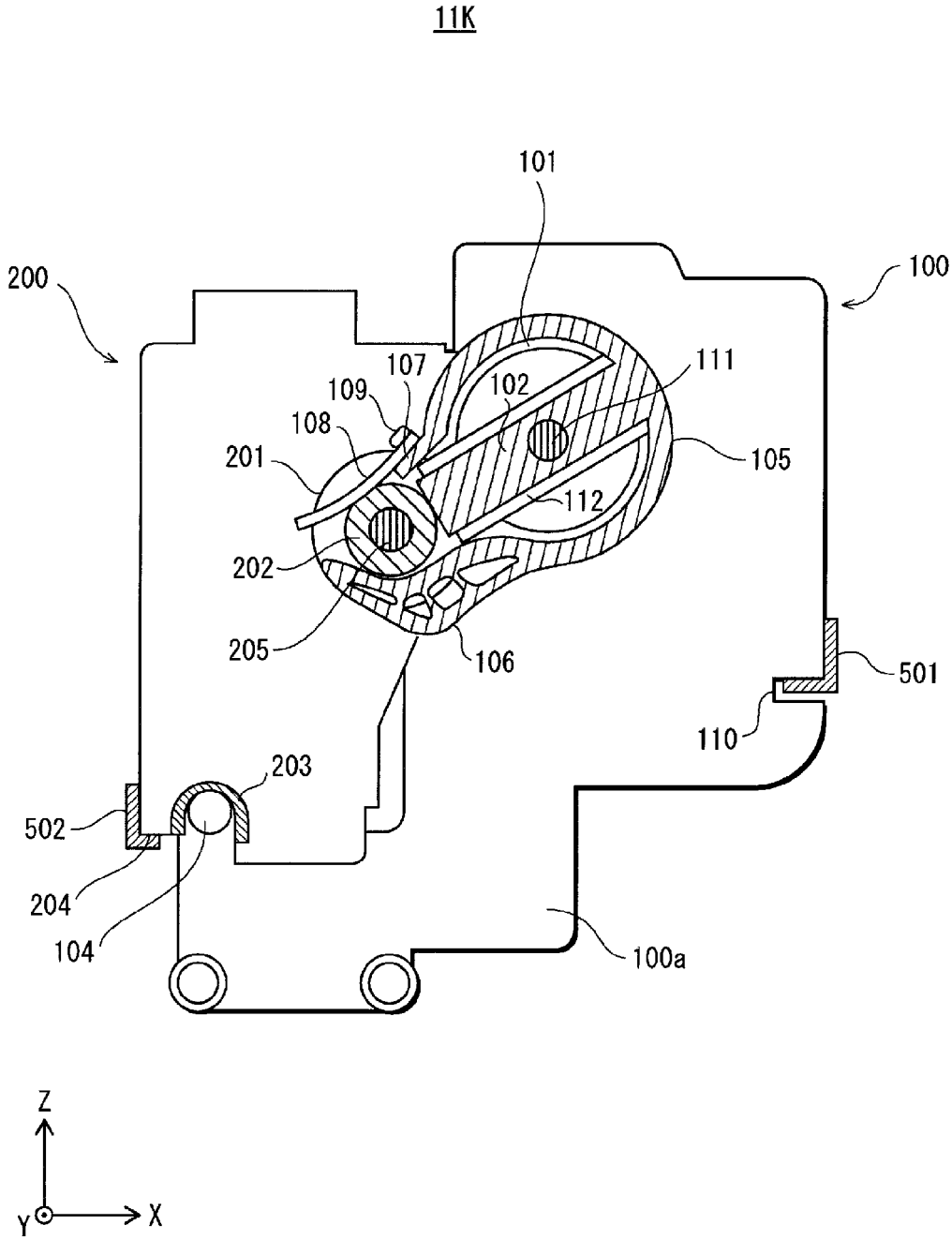
FIG. 4 is a sectional side view showing the imaging unit in the state where the developing unit and the photosensitive unit are brought close to face each other.

FIG. 3 and FIG. 4 show, in particular, the structure of a positioning mechanism for retaining the developing gap in the imaging unit 11K. The figures show the imaging unit 11K in a section taken across an abutting member 102 provided for the photosensitive drum (i.e. photosensitive drum side abutting member 102) and along a direction perpendicular to a rotational axis 111 of the photosensitive drum 101.

Note that the description here aims to explain the positioning mechanism, and other components that are not particularly relevant to the positioning mechanism of the imaging unit 11K are not shown for the sake of simplification.

FIG. 3 shows the state where developing roller 201 is spaced away from the photosensitive drum 101 (referred to below as "separate state"). FIG. 4 shows the state where the developing unit 200 is positioned relative to photosensitive unit 100, such that the photosensitive drum 101 and the developing roller 201 face each other with the developing gap therebetween (referred to below as "facing state").

As shown in FIG. 3, a pivot pin 104 is provided to stand on a housing 100*a* of the photosensitive unit 100. A groove 203 having a semi-circular cross section is provided at the bottom of the developing unit 200. The pivot pin 104 is fitted in the groove 203, so that the developing unit 200 is pivotally held about the pivot pin 104.

The developing roller 201 has a shaft 205, and around the shaft 205, rollers (referred to below as "DS rollers") 202 for adjusting the developing gap are provided on both end portions of the shaft 205 (see FIG. 5).

Meanwhile, the present embodiment employs a magnetic brush developing method using a two-component developer. The developing roller body 201*a* has a developing sleeve, and a magnet roller is inserted into the developing sleeve. The magnet roller is fixed to the shaft 205, and the developing sleeve is pivotally supported about the shaft 205 by bearings (since these structures are well-known, the internal structure is not particularly shown and is represented simply as the developing roller body 201*a*). The shaft 205 is held immovable relative to the housing 209 of the developing unit 200. That is to say, the DS rollers 202 are held immovable relative to the housing 209.

To carry out the positioning, the developing unit 200 is pivoted about the pivot pin 104 towards the photosensitive unit 100 from the separate state shown in FIG. 3, thus caused to transition to the facing state shown in FIG. 4.

In the facing state, each DS roller 202 is received in a space formed by the photosensitive drum 101 and the housing 105. Specifically, the space is formed between a receiving member 106 with a hook-shaped cross section provided below the photosensitive drum 101, and the photosensitive drum side abutting member 102 is provided for a housing 105 receiving the photosensitive drum 101. The outer circumferential surface of the DS roller 202 is in abutting contact with the abutting member 102, so that the developing gap between the photosensitive drum 101 and the developing roller 201 is set to a prescribed value (in the description below, it is called "positioning operation" to set the developing gap between the photosensitive drum 101 and the developing roller 201 to the prescribed value, by bringing the DS roller 202 into abutting contact with the photosensitive drum side abutting member 102).

In the state where the DS roller 202 and the photosensitive drum side abutting member 102 are in abutting contact with each other, a leaf spring 108 is fixed by a screw 109 to a leaf spring fixing member 107 of the housing 105. As a result, the leaf spring 108 exerts a biasing force on the DS roller 202, so that the DS roller 202 is pressed against the receiving member 106 and the photosensitive drum side abutting member 102. Under the biasing force exerted by the leaf spring 108, the developing unit 200 is stably and properly positioned relative to the photosensitive unit 100.

In the present embodiment, the imaging unit 11K is mounted in the main body of the printer 1 after the above-described positioning is performed.

Meanwhile, the prescribed value of the developing gap is normally set to fall from around 0.2 mm to around 0.5 mm, depending on the types of the printer 1 and the developer. In addition, the photosensitive drum side abutting member 102, the receiving member 106, and the leaf spring fixing member 107 may be formed integrally as a single piece with the housing 105.

In FIG. 4, two guide rails 501 and 502 extending in a direction perpendicular to the figure (i.e. Y axis direction in FIG. 4) is attached to a main body frame (not shown) of the printer 1. The guide rails 501 and 502 have substantially L-shaped cross sections. On the other hand, the photosensitive unit 100 has a sliding groove 110. The imaging unit 11K is pushed towards the backward direction (i.e. the -Y direction in FIG. 4) along the guide rails 501 and 502 to be mounted in the main body of printer 1, while the guide rail 501 is received in the sliding groove 110, and a bottom end portion 204 of the developing unit 200 is received by the guide rail 502*s*.

At the time of maintenance operation etc. of the photosensitive unit 100 and the developing unit 200 and the like, the imaging unit 11K is pulled in the Y direction along the guide rails 501 and 502 and ejected from the main body of printer 1. Then, the screw 109 and the leaf spring 108 are also disengaged to release the fixing of the developing unit 200 to the photosensitive unit 100. The developing unit 200 is then pivoted away from the photosensitive unit 100 about the pivot pin 104. Thus, the separate state shown in FIG. 3 is achieved.

In order to replace the photosensitive unit 100 or the developing unit 200, the developing unit 200 in the separate state is pulled up in a direction shown by an arrow B in FIG. 3 and detached from the photosensitive unit 100. By doing so, one or both of the photosensitive unit 100 and the developing unit 200 may be replaced with a new one.

(1-3. Cleaning Mechanism of Abutting Member of Imaging Unit)

Next, a description is given of a mechanism for cleaning an abutting surface in the positioning mechanism.

Unfortunately, if foreign particles or smears are adhered to the abutting portions of the circumferential surface of the DS roller 202 and the abutting surface of the photosensitive drum side abutting member 102 during the above-described positioning operation, the developing gap is not precisely set to the prescribed value. As a result, the image quality may be degraded.

To address the problem, the imaging unit 11 in the present embodiment has the following cleaning mechanism. That is to say, the foreign particles and smears adhered to the abutting portions of the circumferential surface of the DS roller 202 and the abutting surface of the photosensitive drum side abutting member 102 are cleaned right before the DS roller 202 comes into abutting contact with the photosensitive drum side abutting member 102.

Figure 5:
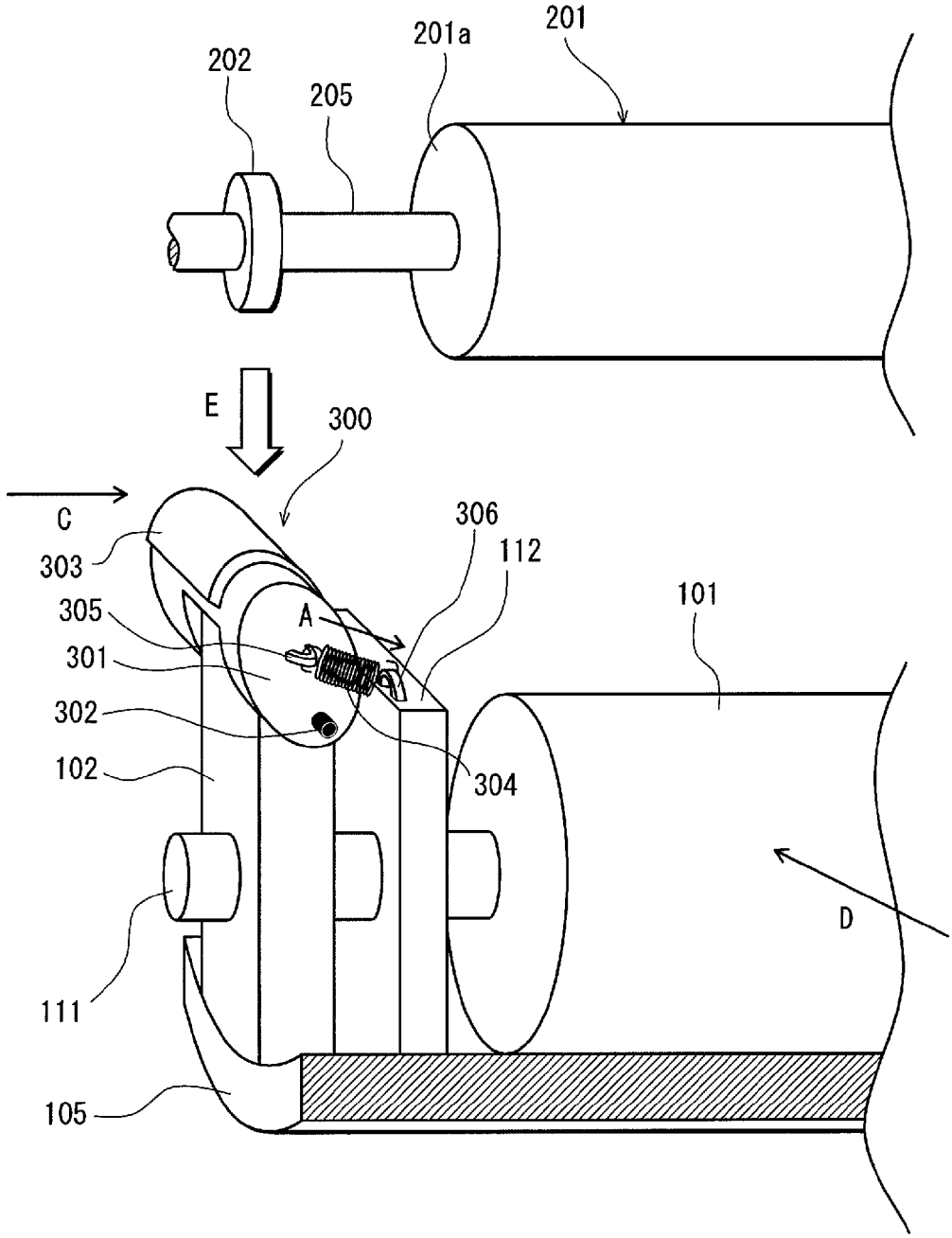
FIG. 5 is a perspective view showing a schematic structure of a cleaner in the imaging unit according to the first embodiment of the present invention.
Figure 6A:
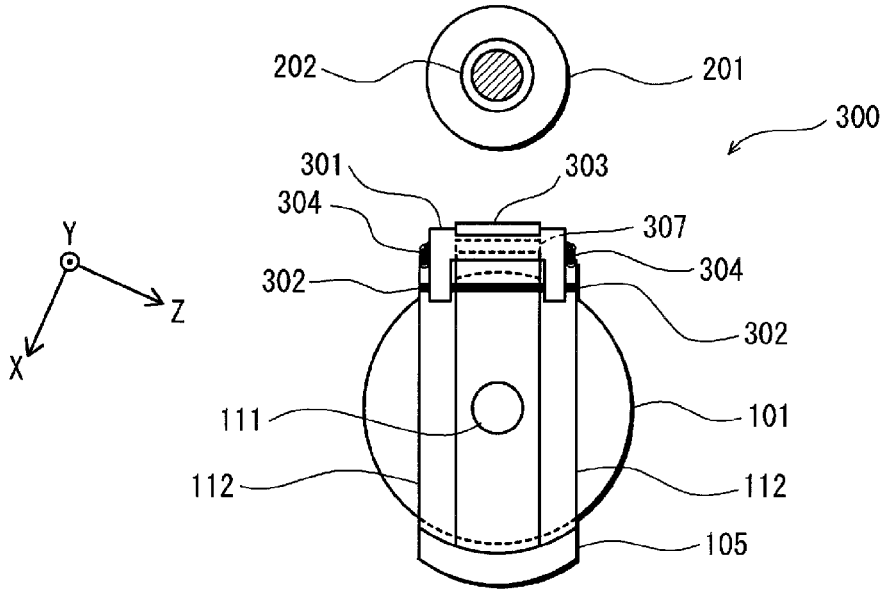
FIGS. 6A and 6B show the schematic structure of the cleaner in the imaging unit according to the first embodiment of the present invention.

FIG. 5 is a perspective view schematically showing the structure around the abutting portions of the DS roller 202 and the photosensitive drum side abutting member 102. FIG. 6A is a view seen in the direction of the arrow C shown in FIG. 5, and FIG. 6B is a view seen in the direction of the arrow D shown in FIG. 5.

Figure 6B:
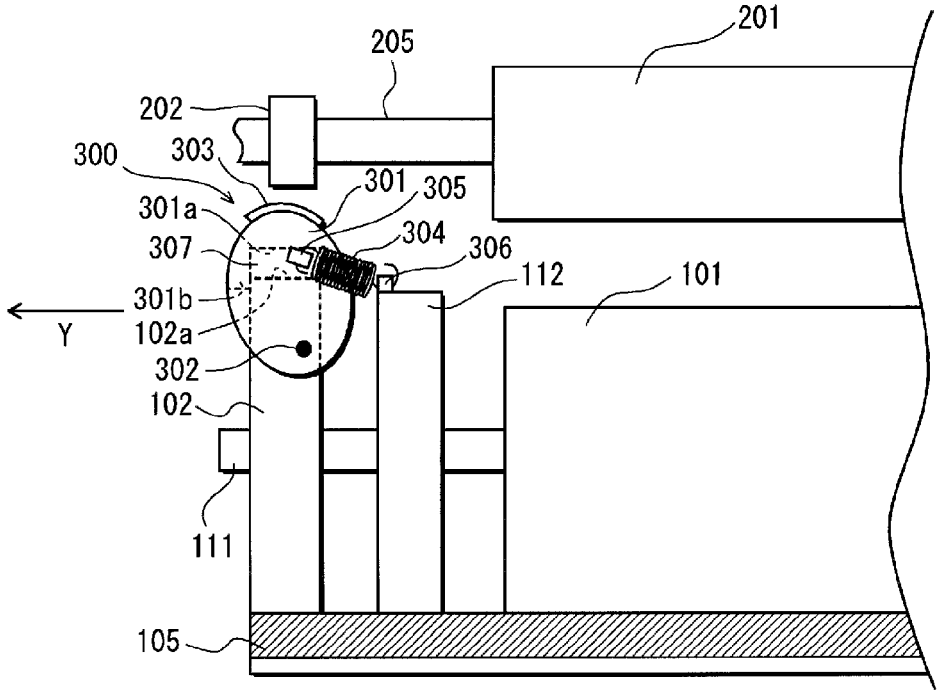

In FIGS. 5, 6A, and 6B, the housing 105 is shown only partially for clarity of illustration. Furthermore, the receiving member 106, the leaf spring fixing member 107, the leaf spring 108, and the screw 109, which are shown in FIGS. 3 and 4, are omitted in FIGS. 5, 6A, and 6B.

As shown in FIG. 5, the cleaning mechanism 300 includes a pivoting member 301, an outer cleaner 303, an inner cleaner 307 (see FIG. 6B), and a tension spring 304.

The pivoting member 301 has an elliptically cylindrical shape, and the central portion in its axis direction is cut out to define a squared U-shape when seen in the minor diameter direction of the elliptical sides. The tip of the abutting member 102 is inserted inside the squared U-shaped portion, so that the pivoting member 301 is pivotally supported by the abutting member about the pivot axis 302.

The pivot axis 302 extends parallel to the axis of the elliptical cylinder of the pivoting member 301, and orthogonally to the rotational axis 111 of the photosensitive drum 101 and the shaft 205 of the developing roller 201.

The photosensitive drum side abutting member 102 and a supporting member 112 are fixed to the housing 105 of the photosensitive unit. The rotational axis 111 of the photosensitive drum 101 is pivotally held by the abutting member 102 and the supporting member 112 by bearings and the like.

The supporting member 112 is provided to stand between the abutting member 102 and the photosensitive drum 101. The hooks provided at both ends of the spring 304 are caught in an arch-shaped catch member 306 provided on the supporting member 112 and an arch-shaped catch member 305 provided on the pivoting member 301. By this means, the pivoting member 301 is biased towards a direction shown by an arrow A in FIG. 5.

On the other hand, the outer cleaner 303 made in a form of sheet is pasted on the outer circumference of the pivoting member 301. The inner cleaner 307 is pasted on the squared U-shaped portion of the pivoting member 301 that faces the upper surface of the photosensitive drum side abutting member 102. The outer cleaner 303 and the inner cleaner 307 are resilient, and made of a material having a relatively low coefficient of sliding friction (e.g. urethane form and felt). The thickness of each of the outer cleaner 303 and the inner cleaner 307 is approximately 1 mm to 3 mm. It is required particularly for the inner cleaner 307 to have a sufficient thickness to be able to make contact with the abutting surface of the photosensitive drum side abutting member 102 with appropriate pressure to rub off the substances adhered to the surface, while also allowing the pivoting member 301 to pivot.

The pivoting member 301 is biased by the spring 304 towards the A direction shown in FIG. 5. However, as shown in FIG. 6B, a step portion 301*b* provided in the squared U-shaped portion of the pivoting member 301 comes into abutting contact with the upper edge of the abutting member 102. This defines the position (referred to below as "initial position") of the pivoting member 301 from which it is not pivoted any further towards the A direction.

In the initial position, the inner cleaner 307 is in contact with the abutting surface 102*a* of the photosensitive drum side abutting member 102, in such a manner that the abutting surface 102*a* is substantially fully covered. The toner powders and other substances therefore cannot adhere to the abutting surface 102*a*.

Figure 7A:
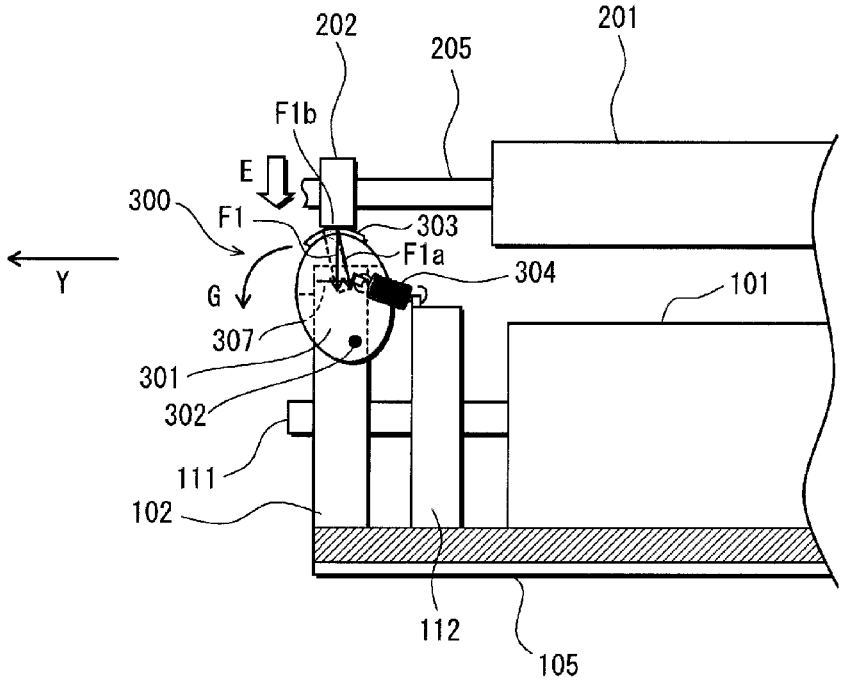
FIGS. 7A and 7B show a mechanism of an action of the cleaner according to the first embodiment of the present invention.
Figure 7B:
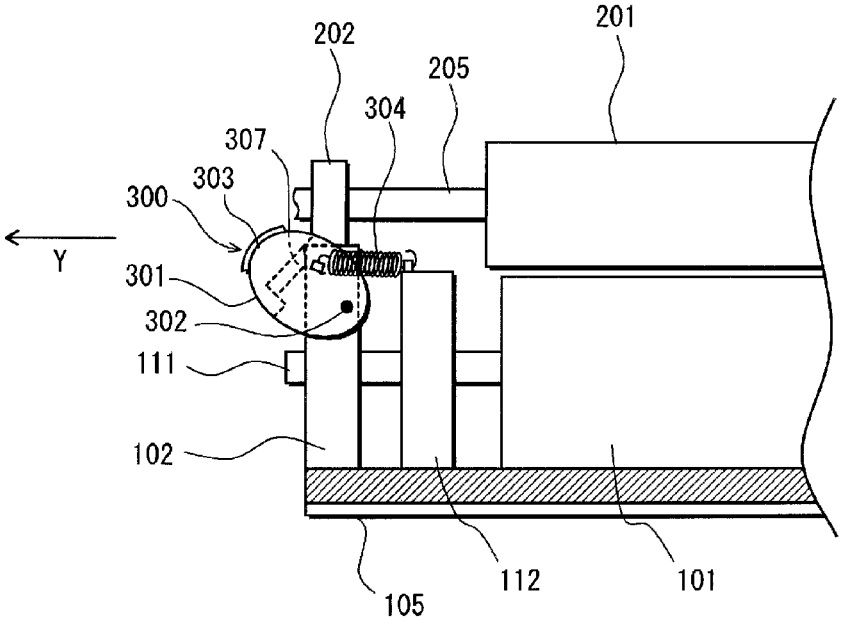

FIGS. 7A and 7B schematically show a process in which the cleaning mechanism 300 cleans the abutting portions of the DS roller 202 and the photosensitive drum side abutting member 102, when the positioning operation is performed. From the separate state of FIG. 6B, the DS roller 202 is brought close to the abutting member 102. FIG. 7A shows a state in the positioning operation where the DS roller has been displaced from the separate state closer to the abutting member 102, and has just come into abutting contact with the outer cleaner 303 of the cleaning mechanism 300.

An arrow E indicates a direction in which the DS roller 202 is brought close to the abutting member 102.

In the state shown in FIG. 7A, the pivoting member 301 receives a force F1 from the DS roller 202 in the E direction via the outer cleaner 303. Note that, as shown in the figure, the pivot axis 302 is located on the right-hand side with respect to the line extending in the arrow E direction from the contact point of the DS roller 202 and the outer cleaner 303.

For this reason, the force F1 can be divided into a force F1*a* and a force F1*b*. The force F1*a* is exerted in a direction parallel to the line passing between the contact point and the pivot axis 302, and the force F1*b* is exercised in a direction perpendicular to the force F1*a*. As a result, the force F1*b* generates rotational torque, thereby pressing the pivoting member 301 to pivot about the pivot axis 302 in a direction shown by an arrow G in the figure.

In conjunction with the pivot movement of the pivoting member 301, the outer cleaner 303 and the inner cleaner 307 are also displaced in the G direction while making sliding contact with the DS roller 202 and the abutting surface 102*a* of the abutting member 102, respectively. In the displacement, the outer cleaner 303 cleans the abutting surface of the DS roller 202, and the inner cleaner 307 cleans the abutting surface 102*a* of the photosensitive drum side abutting member 102.

Consequently, the DS roller 202 comes into abutting contact with the photosensitive drum side abutting member 102, as shown in FIG. 7B. In this state, the outer cleaner 303 and the inner cleaner 307 are displaced outside the abutting areas on the DS roller 202 and the photosensitive drum side abutting member 102.

Meanwhile, from the state (shown in FIG. 7B) where the DS roller 202 and the photosensitive drum side abutting member 102 are in abutting contact, if these two elements are spaced away again, the pivoting member 301 is returned to the initial position under biasing force of the tension spring 304. Thus, the state of FIG. 6B is achieved. In this state, the abutting surface 102*a* of the photosensitive drum side abutting member 102 is again covered by the inner cleaner 307. This prevents the foreign particles and smears from adhering to the abutting surface 102*a*.

Figure 8:
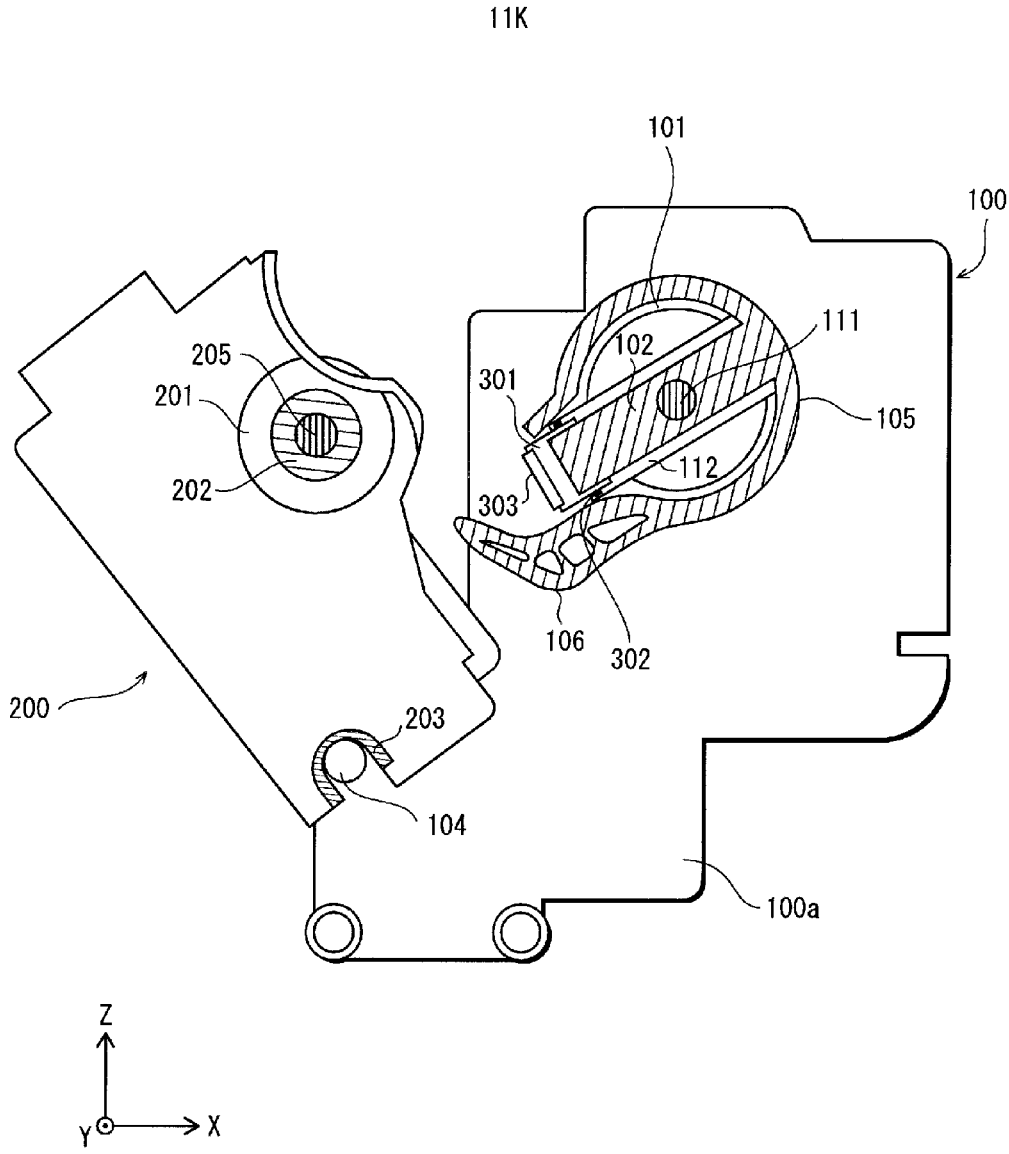
FIG. 8 is a sectional side view showing the imaging unit having a cleaning mechanism according to the first embodiment of the present invention in the state where the developing unit is spaced away from the photosensitive unit.
Figure 9:
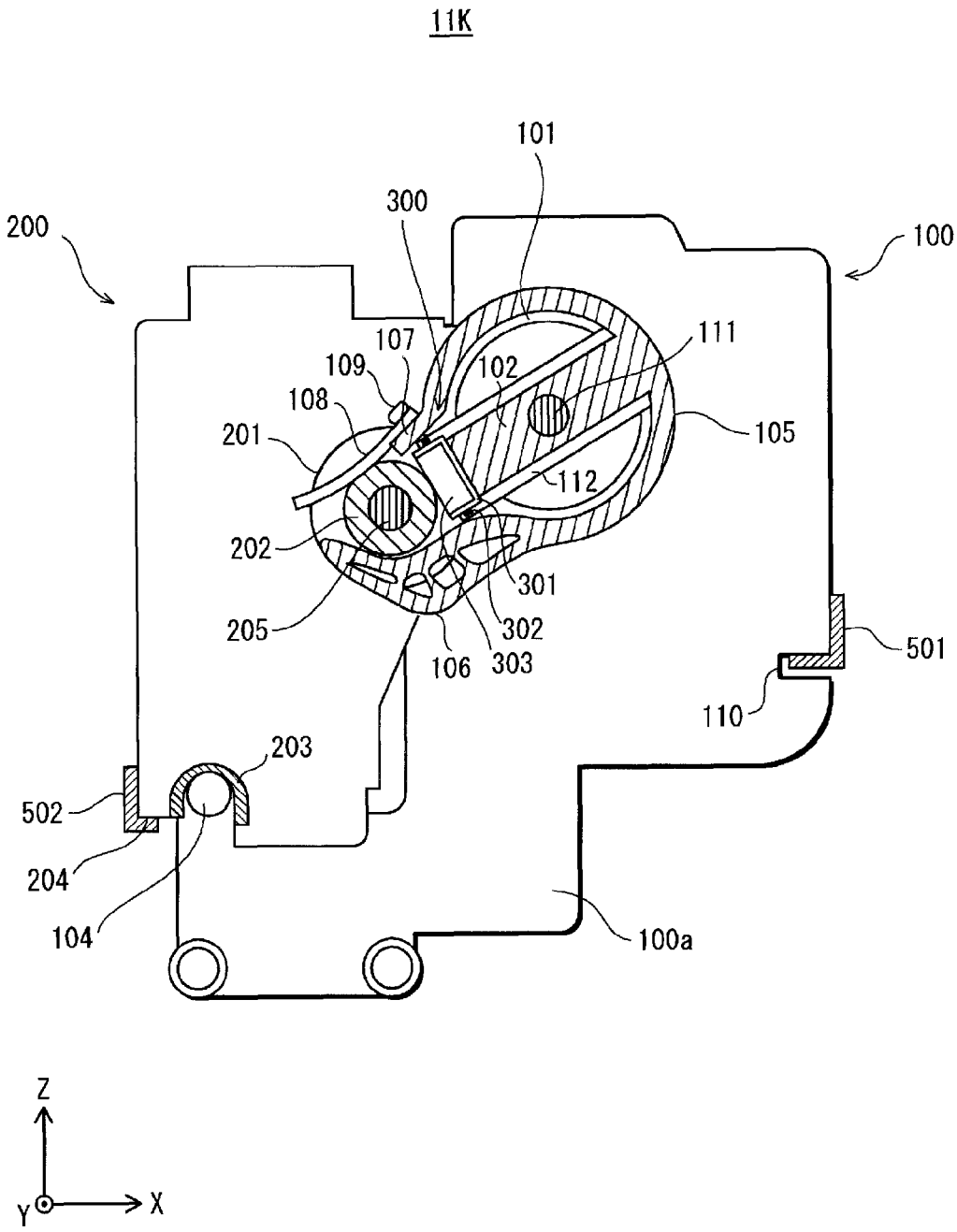
FIG. 9 is a sectional side view showing the imaging unit having the cleaning mechanism according to the first embodiment of the present invention in the state where the developing unit and the photosensitive unit are brought close to face each other.

FIGS. 8 and 9 show the imaging unit 11 having the cleaning mechanism 300. FIG. 8 shows the state where the DS roller 202 is spaced away from the photosensitive drum side abutting member 102, and FIG. 9 shows the state where the DS roller 202 and the photosensitive drum side abutting member 102 are in abutting contact. FIGS. 8 and 9 show the cleaning mechanism 300 seen from the left-hand side (i.e. in the -Y direction) of FIGS. 6B and 7B, respectively. In FIG. 9, the pivoting member 301 is tilted towards the front side (i.e. the Y direction in FIG. 9 and FIG. 7B), and the outer cleaner 303 is displaced towards the Y direction. In FIGS. 8 and 9, the spring 304 and the arch-shaped catch members 305 and 306 are omitted in order to make it easy to understand the respective states of the cleaning mechanism 300.

(1-4. Summary of First Embodiment)

As mentioned above, with the photosensitive drum side abutting member 102 having the cleaning mechanism 300, the outer cleaner 303 is enabled to clean the abutting surface of the DS roller 202, and the inner cleaner 307 is enabled to clean the abutting surface of the photosensitive drum side abutting member 102, right before the DS roller 202 comes into abutting contact with the photosensitive drum side abutting member 102 in the positioning operation. By this means, even if the foreign particles and smears are adhered to the abutting surfaces, they are removed. As a result, it is assured that the developing gap is precisely set to the prescribed value.

The DS roller 202 and the photosensitive drum side abutting member 102 do not rotate. Accordingly, once the DS roller 202 and the abutting member 102 are in abutting contact and the positioning operation ends, then there is no room for the toner powders or foreign particles to fall between the abutting surfaces. As a result, the optimal developing gap is maintained.

[Second Embodiment]

In the first embodiment, the description is given of the following structure. That is to say, as the pivoting member 301 having the outer cleaner 303 and the inner cleaner 307 is pressed by the DS roller 202 to pivot about the pivot axis 302, the outer cleaner 303 and the inner cleaner 307 are displaced while making sliding contact with the DS roller 202 and the abutting surface 102*a* of the photosensitive drum side abutting member 102, respectively. As a result, the abutting surfaces are cleaned.

In the second embodiment, a holding member holding the cleaner is pressed by the DS roller 202 to slide along a tapered surface at a predetermined angle (i.e. having a predetermined inclination angle) with respect to the direction in which the holding member is pressed. The sliding movement of the holding member causes the cleaner to be displaced, whereby the abutting surface of the DS roller 202 is cleaned. In order to avoid duplication, the same reference numerals are applied to the components same as the first embodiment, and the description is omitted.

Figure 10:
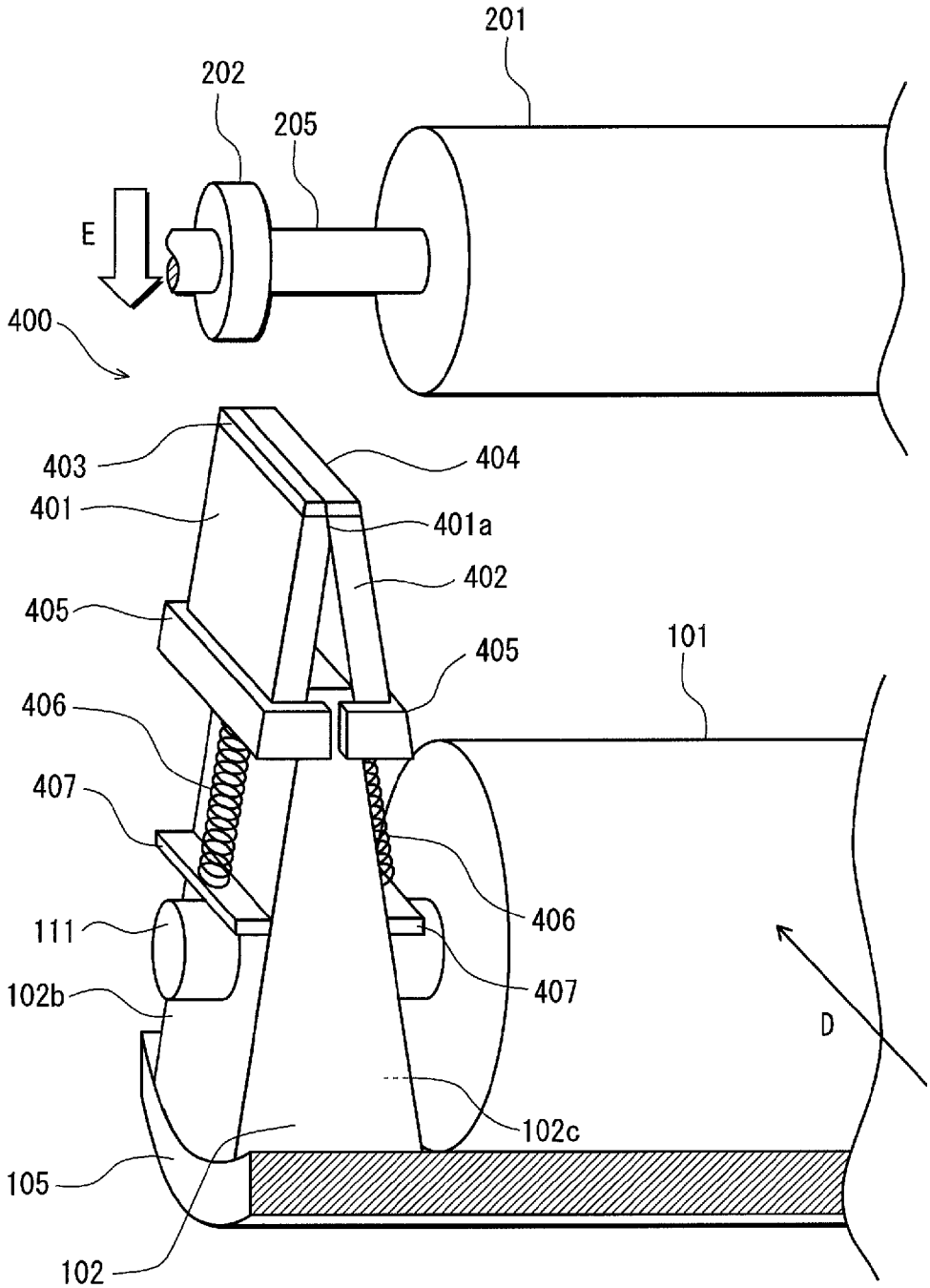
FIG. 10 is a perspective view showing a schematic structure of the cleaner according to the second embodiment of the present invention.

FIG. 10 schematically shows the structure around the abutting surfaces of the DS roller 202 and the photosensitive drum side abutting member 102 in the positioning operation according to the second embodiment. As can be seen from the figure, the photosensitive drum side abutting member 102 has a tapered shape with a thickness decreasing from bottom to top in a direction perpendicular to the rotational axis 111 of the photosensitive drum 101.

The rotational axis 111 of the photosensitive drum 101 is pivotally held by the photosensitive drum side abutting member 102 by the bearings and the like.

The cleaning mechanism 400 includes cleaners 403 and 404, holding members 401 and 402 in a plate shape, a pair of compression springs 406, a pair of spring receivers 407, and a pair of guide members 405.

The pair of holding members 401 and 402 are held in such a manner that the holding members 401 and 402 are capable of sliding up and down along tapered surfaces 102*b* and 102*c*, while being guided by the pair of guide members 405.

The pair of spring receivers 407 are fixed to the tapered surfaces 102*b* and 102*c* formed on both sides of the photosensitive drum side abutting member 102. Each of the pair of compression springs 406 is secured at one end to a respective one of the pair of spring receivers 407. The compression springs 406 bias the bottoms of the holding members 401 and 402 upwards.

The cleaners 403 and 404 are pasted to upper surfaces of the holding members 401 and 402. The holding members 401 and 402 are made of materials having a certain degree of rigidity (e.g. poron). The cleaner 403 and 404 are made of materials having a relatively low coefficient of sliding friction (e.g. urethane foam and felt).

It is also possible to paste materials having a relatively low coefficient of sliding friction (e.g. urethane foam and felt) onto the surfaces of the holding members 401 and 402 sliding along the tapered surfaces 102*b* and 102*c*.

In the separate state, the holding members 401 and 402 are in a position (initial position) shown in FIG. 10 under the biasing forces from the pair of compression springs 406. In this state, the upper surface of the cleaner 403 and the upper surface of the cleaner 404 lie on the same plane. A chamfered edge 401*a* is formed at the tip of the holding member 401 facing the holding member 402. By this means, the contact area between the holding members 401 and 402 is increased, whereby the initial position is stably maintained.

Naturally, sometimes there are disparities in biasing forces between the pair of compression springs 406. With the disparities taken into consideration, engaging projections may be provided in appropriate locations on the holding members 401 and 402. By bringing the engaging projections into abutting contact with the guide members 405, it is possible to prevent the holding members 401 and 402 from protruding above the initial position. As a result, the initial position is more stably maintained.

Figure 11A:
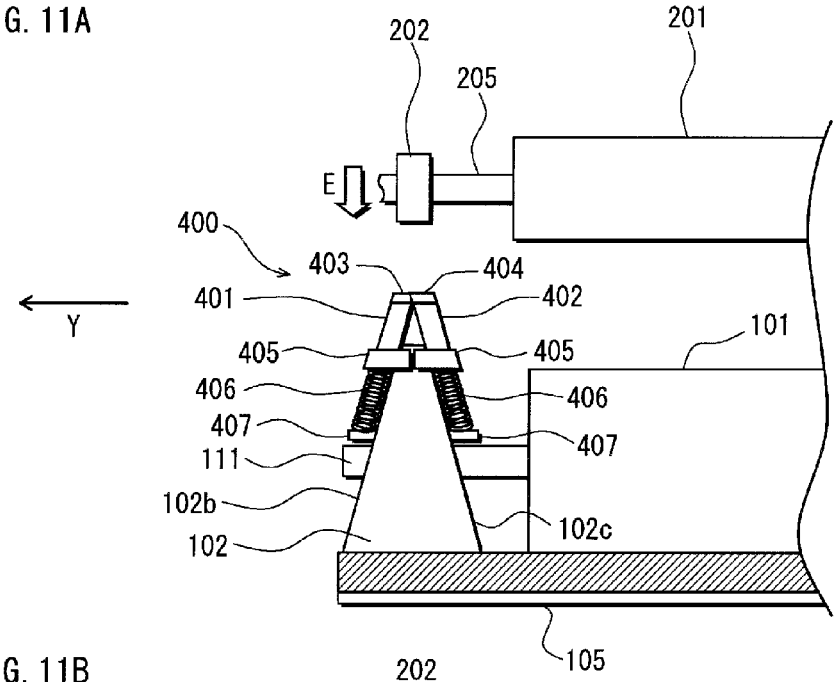
FIGS. 11A, 11B, and 11C, seen in a direction of an arrow D shown in FIG. 10, are arrow views (front views) showing the mechanism of the action of the cleaner according to the second embodiment of the present invention.
Figure 11B:
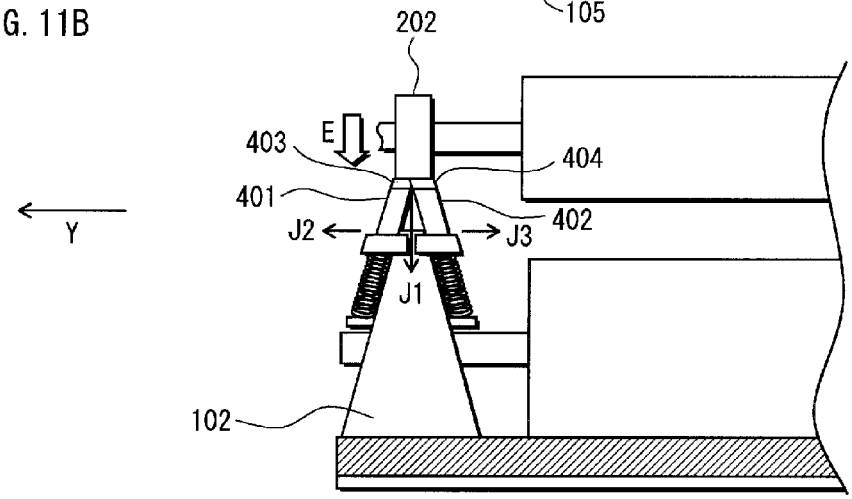
Figure 11C:
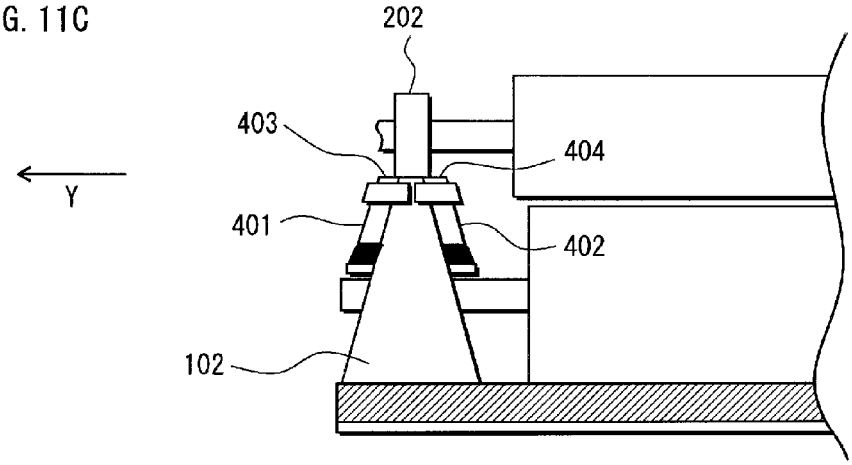

FIGS. 11A, 11B, and 11C schematically show a process in which the abutting surface of the DS roller 202 is cleaned by the cleaning mechanism 400 in the second embodiment.

FIG. 11A is a view seen in the direction of an arrow D shown in FIG. 10, showing the initial positions of the DS roller 202 and the cleaning mechanism 400 in the separate state. In this state, the holding members 401 and 402 function as umbrellas covering the abutting surface of the photosensitive drum side abutting member 102. This prevents the toner powders and other substances from adhering to the abutting surface of the photosensitive drum side abutting member 102.

FIG. 11B shows the state where the DS roller 200 has been displaced from the separate state towards the direction (of an arrow "E") to be closer to the photosensitive drum side abutting member 102 and has just come into contact with the cleaners 403 and 404 of the cleaning mechanism 400. In this state, the holding members 401 and 402 are pressed by the DS roller 202 towards a direction shown by an arrow J1 via the cleaners 403 and 404, respectively. Pressed towards the J1 direction, the holding members 401 and 402 slide down along the tapered surfaces 102*b* and 102*c*, respectively.

As the holding members 401 and 402 slide down, the interval between the cleaners 403 and 404 increases. Accordingly, the holding members 401 and 402 are displaced towards J2 and J3 directions relative to each other, while sliding against the abutting portion of the DS roller 202. This removes the foreign particles and smears, if any, from the abutting portion.

At the end, the DS roller 202 comes into abutting contact with the photosensitive drum side abutting member 102, as shown in FIG. 11C. In this state, the holding members 401 and 402 have slid down along the tapered surfaces 102*b* and 102*c*, and the cleaners 403 and 404 have been displaced outside the abutting area between the DS roller 202 and the photosensitive drum side abutting member 102.

Once the DS roller 202 is spaced away from the photosensitive drum side abutting member 102, the holding members 401 and 402 are biased by the compression springs 406 towards the DS roller 202. The holding members 401 and 402 therefore return from the position shown in FIG. 11C to the initial position (see FIG. 11A) along the tapered surfaces 102*b* and 102*c*. In the initial position, the holding members 401 and 402 cover the abutting surface of the photosensitive drum side abutting member 102. As a result, the toner powders and smears are prevented from adhering to the abutting surface.

<Modifications>

The present invention has been described based on, but is by no means limited to, the above-described embodiments.

Modifications such as the following may be implemented within the scope of the present invention.

(1) Although in the first and second embodiments the cleaning mechanisms 300 and 400 are provided on the photosensitive drum side abutting member 102, the present invention is not limited to these embodiments. On the contrary, the cleaning mechanism 300 or 400 may be provided on the abutting member of the developing unit, that is, the DS roller 202. In this case, it might be difficult to attach the cleaning mechanism 300 or 400 to the DS roller 202 having a shape of a disc or cylinder. Then, the DS roller may be formed in a cube or any other polygonal column shape (cleaning mechanism 300), or a polygonal column shape having a tapered surface (cleaning mechanism 400). Furthermore, the photosensitive drum side abutting member 102 may be in the form of a disc or a cylinder.

(2) In the first embodiment, the pivoting member 301 has the outer cleaner 303 on the outer circumferential surface thereof. The pivoting member 301 also has the inner cleaner 307 on a surface of the squared U-shaped portion. In the embodiment, the outer cleaner 303 cleans the abutting surface of the DS roller 202, and the inner cleaner 307 cleans the abutting surface of the photosensitive drum side abutting member 102.

However, in the separate state, the abutting surface of the photosensitive drum side abutting member 102 is covered inside the squared U shaped portion of the pivoting member 301. This, to some extent, prevents the foreign particles and smears from adhering to the abutting surface. Accordingly, the pivoting member 301 may not be provided with the inner cleaner 307.

(3) Although in the second embodiment the photosensitive drum side abutting member 102 has the pair of tapered surfaces on both sides thereof, the present invention is not limited to the embodiment. On the contrary, the abutting member 102 may have one tapered surface on only one side thereof. In this case, it is preferable that in the separated state the cleaner disposed on the supporting member covers all the way to an extension of a surface on the opposite side.

(4) In the second embodiment, in the separate state, the holding members 401 and 402 cover the abutting surface of the photosensitive drum side abutting member 102. In this structure, the abutting surface of the photosensitive drum side abutting member 102 is not completely covered all around. It is not covered (i.e. open) between the side surfaces of the holding members 401 and 402. Accordingly, there is a risk that the foreign particles and dust enter from the open sides and adhere to the abutting surface. In order to avoid the risk, wall members for covering the open sides may be provided. By doing so, in the separate state, the abutting surface of the photosensitive drum side abutting member 102 is completely covered all around. As a result, the foreign particles and smears are even more effectively prevented from adhering to the abutting surface.

The wall members may be provided along the both lateral sides of the photosensitive drum side abutting member 102 or along the both lateral sides of the guide members 405 in a fixed manner. Alternatively, the wall members may be provided on the both lateral sides of each of the holding members 401 and 402, such that they are displaced in accordance with the movements of the holding members 401 and 402 in the positioning operation. However, it should be noted that the wall members should be provided in a manner such that they are smoothly displaceable with respect to the photosensitive drum side abutting member 102 and the guide members 405 so as not to prevent the movements of the holding members 401 and 402.

(5) In the first and the second embodiments, the developing unit 200 is pivotally supported by the photosensitive unit 100 about the pivot pin 104. In the embodiments, the positioning operation is performed by causing the developing unit 200 to pivot with respect to the photosensitive unit 100 and bringing the DS roller 202 into abutting contact with the photosensitive drum side abutting member 102.

However, a method for allowing the developing unit 200 and the photosensitive unit 100 to be spaced away from or brought close to each other is not limited to the above pivot structure. For example, it is possible to perform the positioning operation using the abutting member having the cleaning mechanism similar to the above, while bringing the developing unit close to the photosensitive unit 100 by displacing it in parallel along the guide member, such as a rail.

Furthermore, if the developing roller and the photosensitive drum are supported steadily enough by the respective axes with respect to the respective housings, the abutting members may be provided in the respective housings themselves. By doing so, the developing gap is set to be the prescribed value.

Moreover, although in the above embodiments the developing unit and the photosensitive unit are combined as the imaging unit before mounted in the main body of the apparatus, the present invention is not limited to these embodiments. The developing unit and the photosensitive unit may be formed in a manner such that they are separately detachable from the main body of the apparatus. In this case, the positioning operation may be performed after these two units are mounted in the main body of the apparatus.

The present invention may be any combination of the above-described embodiments and modifications.

The features and effects of the present invention are summarized below.

One aspect of the present invention may be an imaging unit comprising: a developing unit having a developing roller and a first abutting member; a photosensitive unit having a photosensitive drum and a second abutting member, a gap between the photosensitive drum and the developing roller being set constant by bringing the first abutting member into abutting contact with the second abutting member; a cleaner configured to be disposed in a space between the first and the second abutting members in a separate state where the first abutting member is spaced away from the second abutting member; and a displacement unit configured to displace the cleaner from the space as the first abutting member is brought close to the second abutting member, wherein in the displacement, the displacement unit causes the cleaner to slide on an abutting surface of at least one of the first and the second abutting members.

With the above structure, while the abutting members of the developing unit and the photosensitive unit are brought close to be in abutting contact with each other, the cleaner is displaced while cleaning the abutting surface of the at least one of the first and the second abutting members. Accordingly, the foreign particles and smears adhered to the abutting surface are removed, whereby it is assured that the developing gap is set to the prescribed value.

Furthermore, the abutting members do not need to be made in the form of rotating bodies, such as photosensitive drums. This prevents problems associated with conventional techniques. For example, the change in the developing gap over time due to friction is prevented, and large size motors are not required.

Another aspect of the present invention provides the imaging unit, wherein the displacement unit includes a pivoting member pivotally supported by one of the developing unit and the photosensitive unit, the cleaner is retained by the pivoting member, and the pivoting member (i) is positioned such that the cleaner is disposed in the space in the separate state and (ii) has such a profile and a pivot point that, in the displacement, the cleaner comes into contact with the abutting surface of a corresponding one of the first and the second abutting members, so that the pivoting member is pressed to pivot in a predetermined direction, thereby displacing the cleaner from the space.

Yet another aspect of the present invention provides the imaging unit, wherein one of the first and the second abutting members has a tapered surface at a predetermined angle with respect to a direction in which the first abutting member is brought close to the second abutting member, the displacement unit includes: a holding member configured to hold the cleaner such that the cleaner is slidable along the tapered surface; and a bias member configured to bias the holding member towards the other abutting member, in the separate state, the cleaner is held to cover the abutting surface of the one of the first and the second abutting members having the tapered surface, and the angle of the tapered surface is determined such that, in the displacement, the cleaner comes into contact with the abutting surface of corresponding one of the first and the second abutting members, so that the holding member is pressed to slide on the tapered surface, thereby displacing the cleaner from the gap.

With the above structure, in conjunction with the operation for bringing the abutting member of the developing unit into abutting contact with the abutting member of the photosensitive unit, the cleaner is automatically displaced. Accordingly, even at low cost, the abutting surface is cleaned, and it is assured that the foreign particles and smears are removed, whereby the developing gap is set to the prescribed value.

Yet another aspect of the present invention provides the imaging unit, wherein one of the first and the second abutting members has a pair of tapered surfaces each at the predetermined angle with respect to the direction in which the first abutting member is brought close to the second abutting member, the displacement unit is disposed on each tapered surface, and the angle of each tapered surface is determined such that, in the separate state, the cleaners held by the holding members of the displacement units are in contact with each other.

With the above structure, in the separate state where the first and the second abutting members are spaced away, the foreign particles and smears are, to some extent, prevented from adhering to the abutting surface of the one of the first and the second abutting members having the pair of tapered surfaces.

Furthermore, another aspect of the present invention may be, in an imaging unit including a developing unit and a photosensitive unit, the developing unit comprising a developing roller; a first abutting member, a gap between the developing roller and a photosensitive drum of the photosensitive unit being set constant by bringing the first abutting member into abutting contact with a second abutting member of the photosensitive unit; a cleaner configured to be disposed in a space between the first and the second abutting members in a separate state where the first abutting member is spaced away from the second abutting member; and a displacement unit configured to displace the cleaner from the space as the first abutting member is brought close to the second abutting member, wherein in the displacement, the displacement unit causes the cleaner to slide on an abutting surface of at least the second of the first and the second abutting members.

Moreover, another aspect of the present invention may be, in an imaging unit including a photosensitive unit and a developing unit having a developing roller and a first abutting member, the photosensitive unit comprising: a photosensitive drum; a second abutting member, a gap between the photosensitive drum and the developing roller being set constant by bringing the first abutting member into abutting contact with the second abutting member; a cleaner configured to be disposed in a space between the first and the second abutting members in a separate state where the first abutting member is spaced away from the second abutting member; and a displacement unit configured to displace the cleaner from the space as the first abutting member is brought close to the second abutting member, wherein in the displacement, the displacement unit causes the cleaner to slide on an abutting surface of at least the first of the first and the second abutting members.

An image forming apparatus including one of the imaging unit, the developing unit, and the photosensitive unit as mentioned above, is also included in the scope of the present invention. In this case, the effects as mentioned above may be achieved.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An imaging unit, comprising:

a developing unit having a developing roller and a first abutting member;

a photosensitive unit having a photosensitive drum and a second abutting member, a gap between the photosensitive drum and the developing roller being set constant by bringing the first abutting member into abutting contact with the second abutting member;

a cleaner configured to be disposed in a space between the first and the second abutting members in a separate state where the first abutting member is spaced away from the second abutting member; and a displacement unit configured to displace the cleaner from the space as the first abutting member is brought close to the second abutting member, wherein in the displacement, the displacement unit causes the cleaner to slide on an abutting surface of at least one of the first and the second abutting members.

2. The imaging unit of claim 1, wherein the displacement unit includes a pivoting member pivotally supported by one of the developing unit and the photosensitive unit, the cleaner is retained by the pivoting member, and the pivoting member (i) is positioned such that the cleaner is disposed in the space in the separate state and (ii) has such a profile and a pivot point that, in the displacement, the cleaner comes into contact with the abutting surface of a corresponding one of the first and the second abutting members, so that the pivoting member is pressed to pivot in a predetermined direction, thereby displacing the cleaner from the space.

3. The imaging unit of claim 1, wherein one of the first and the second abutting members has a tapered surface at a predetermined angle with respect to a direction in which the first abutting member is brought close to the second abutting member, the displacement unit includes:

a holding member configured to hold the cleaner such that the cleaner is slidable along the tapered surface; and a bias member configured to bias the holding member towards the other abutting member, in the separate state, the cleaner is held to cover the abutting surface of the one of the first and the second abutting members having the tapered surface, and the angle of the tapered surface is determined such that, in the displacement, the cleaner comes into contact with the abutting surface of a corresponding one of the first and the second abutting members, so that the holding member is pressed to slide on the tapered surface, thereby displacing the cleaner from the gap.

4. The imaging unit of claim 3, wherein one of the first and the second abutting members has a pair of tapered surfaces each at the predetermined angle with respect to the direction in which the first abutting member is brought close to the second abutting member, the displacement unit is disposed on each tapered surface, and the angle of each tapered surface is determined such that, in the separate state, the cleaners held by the holding members of the displacement units are in contact with each other.

5. In an imaging unit including a developing unit and a photosensitive unit, the developing unit comprising:

a developing roller;

a first abutting member, a gap between the developing roller and a photosensitive drum of the photosensitive unit being set constant by bringing the first abutting member into abutting contact with a second abutting member of the photosensitive unit;

a cleaner configured to be disposed in a space between the first and the second abutting members in a separate state where the first abutting member is spaced away from the second abutting member; and a displacement unit configured to displace the cleaner from the space as the first abutting member is brought close to the second abutting member, wherein in the displacement, the displacement unit causes the cleaner to slide on an abutting surface of at least the second of the first and the second abutting members.

6. The developing unit of claim 5, wherein the displacement unit includes a pivoting member pivotally supported by the developing unit, the cleaner is retained by the pivoting member, and the pivoting member (i) is positioned such that the cleaner is disposed in the space in the separate state and (ii) has such a profile and a pivot point that, in the displacement, the cleaner comes into contact with the abutting surface of the second abutting member, so that the pivoting member is pressed to pivot in a predetermined direction, thereby displacing the cleaner from the space.

7. The developing unit of claim 5, wherein the first abutting member has a tapered surface at a predetermined angle with respect to a direction in which the first abutting member is brought close to the second abutting member, the displacement unit includes:

a holding member configured to hold the cleaner such that the cleaner is slidable along the tapered surface; and a bias member configured to bias the holding member towards the second abutting member, in the separate state, the cleaner is held to cover the abutting surface of the first abutting member, and the angle of the tapered surface is determined such that, in the displacement, the cleaner comes into contact with the abutting surface of the second abutting member, so that the holding member is pressed to slide on the tapered surface, thereby displacing the cleaner from the gap.

8. In an imaging unit including a photosensitive unit and a developing unit having a developing roller and a first abutting member, the photosensitive unit comprising:

a photosensitive drum;

a second abutting member, a gap between the photosensitive drum and the developing roller being set constant by bringing the first abutting member into abutting contact with the second abutting member;

a cleaner configured to be disposed in a space between the first and the second abutting members in a separate state where the first abutting member is spaced away from the second abutting member; and a displacement unit configured to displace the cleaner from the space as the first abutting member is brought close to the second abutting member, wherein in the displacement, the displacement unit causes the cleaner to slide on an abutting surface of at least the first of the first and the second abutting members.

9. The photosensitive unit of claim 8, wherein the displacement unit includes a pivoting member pivotally supported by the photosensitive unit, the cleaner is retained by the pivoting member, and the pivoting member (i) is positioned such that the cleaner is disposed in the space in the separate state and (ii) has such a profile and a pivot point that, in the displacement, the cleaner comes into contact with the abutting surface of the first abutting member, so that the pivoting member is pressed to pivot in a predetermined direction, thereby displacing the cleaner from the space.

10. The photosensitive unit of claim 8, wherein the second abutting member has a tapered surface at a predetermined angle with respect to a direction in which the first abutting member is brought close to the second abutting member, the displacement unit includes:

a holding member configured to hold the cleaner such that the cleaner is slidable along the tapered surface; and a bias member configured to bias the holding member towards the first abutting member, in the separate state, the cleaner is held to cover the abutting surface of the second abutting member, and the angle of the tapered surface is determined such that, in the displacement, the cleaner comes into contact with the abutting surface of the first abutting member, so that the holding member is pressed to slide on the tapered surface, thereby displacing the cleaner from the gap.

11. An image forming apparatus including the imaging unit of claim 1.

12. The image forming apparatus of claim 11, wherein the displacement unit includes a pivoting member pivotally supported by one of the developing unit and the photosensitive unit, the cleaner is retained by the pivoting member, and the pivoting member (i) is positioned such that the cleaner is disposed in the space in the separate state and (ii) has such a profile and a pivot point that, in the displacement, the cleaner comes into contact with the abutting surface of a corresponding one of the first and the second abutting members, so that the pivoting member is pressed to pivot in a predetermined direction, thereby displacing the cleaner from the space.

13. The image forming apparatus of claim 11, wherein one of the first and the second abutting members has a tapered surface at a predetermined angle with respect to a direction in which the first abutting member is brought close to the second abutting member, the displacement unit includes:

a holding member configured to hold the cleaner such that the cleaner is slidable along the tapered surface; and a bias member configured to bias the holding member towards the other abutting member, in the separate state, the cleaner is held to cover the abutting surface of the one of the first and the second abutting members having the tapered surface, and the angle of the tapered surface is determined such that, in the displacement, the cleaner comes into contact with the abutting surface of a corresponding one of the first and the second abutting members, so that the holding member is pressed to slide on the tapered surface, thereby displacing the cleaner from the gap.

14. An image forming apparatus including the developing unit of claim 5.

15. The image forming apparatus of claim 14, wherein the displacement unit includes a pivoting member pivotally supported by the developing unit, the cleaner is retained by the pivoting member, and the pivoting member (i) is positioned such that the cleaner is disposed in the space in the separate state and (ii) has such a profile and a pivot point that, in the displacement, the cleaner comes into contact with the abutting surface of the second abutting member, so that the pivoting member is pressed to pivot in a predetermined direction, thereby displacing the cleaner from the space.

16. The image forming apparatus of claim 14, wherein the first abutting member has a tapered surface at a predetermined angle with respect to a direction in which the first abutting member is brought close to the second abutting member, the displacement unit includes:

a holding member configured to hold the cleaner such that the cleaner is slidable along the tapered surface; and a bias member configured to bias the holding member towards the second abutting member, in the separate state, the cleaner is held to cover the abutting surface of the first abutting member, and the angle of the tapered surface is determined such that, in the displacement, the cleaner comes into contact with the abutting surface of the second abutting member, so that the holding member is pressed to slide on the tapered surface, thereby displacing the cleaner from the gap.

17. An image forming apparatus including the photosensitive unit of claim 8.

18. The image forming apparatus of claim 17, wherein the displacement unit includes a pivoting member pivotally supported by the photosensitive unit, the cleaner is retained by the pivoting member, and the pivoting member (i) is positioned such that the cleaner is disposed in the space in the separate state and (ii) has such a profile and a pivot point that, in the displacement, the cleaner comes into contact with the abutting surface of the first abutting member, so that the pivoting member is pressed to pivot in a predetermined direction, thereby displacing the cleaner from the space.

19. The image forming apparatus of claim 17, wherein the second abutting member has a tapered surface at a predetermined angle with respect to a direction in which the first abutting member is brought close to the second abutting member, the displacement unit includes:

a holding member configured to hold the cleaner such that the cleaner is slidable along the tapered surface; and a bias member configured to bias the holding member towards the first abutting member, in the separate state, the cleaner is held to cover the abutting surface of the second abutting member, and the angle of the tapered surface is determined such that, in the displacement, the cleaner comes into contact with the abutting surface of the first abutting member, so that the holding member is pressed to slide on the tapered surface, thereby displacing the cleaner from the gap.

* * * * *